US005595331A

United States Patent [19]

Leistner

[11] Patent Number: 5,595,331

[45] Date of Patent: Jan. 21, 1997

[54] CLAMPING COAT HANGER FOR GARMENTS

[76] Inventor: Corinna Leistner, Leipziger Strasse 16, D-06/25 Reuden, Germany

[21] Appl. No.: 520,900

[22] Filed: Aug. 30, 1995

[30] Foreign Application Priority Data

Aug. 30, 1994 [DE] Germany ..... 44 30 752.7

[51] Int. Cl.[6] ..... A47G 25/48

[52] U.S. Cl. ..... 223/91; 223/93; 223/96; 24/511

[58] Field of Search ..... 223/85, 90, 91, 223/93, 96; 24/511, 501

[56] References Cited

U.S. PATENT DOCUMENTS

| | | | |
|---|---|---|---|
| 2,408,145 | 9/1946 | Johnson | 223/96 |
| 2,543,108 | 2/1951 | Helwig . | |
| 2,723,063 | 11/1955 | Carr | 223/91 |
| 2,943,372 | 7/1960 | Fleming | 24/511 |
| 3,946,915 | 3/1976 | Crane | 223/96 |
| 4,044,928 | 8/1977 | Watanabe . | |
| 4,169,549 | 10/1979 | Takagi . | |
| 4,658,996 | 4/1987 | Warmath | 24/511 |
| 5,020,704 | 6/1991 | Kent . | |
| 5,301,393 | 4/1994 | Brown | 24/511 |
| 5,402,558 | 4/1995 | Santapa | 24/511 |

FOREIGN PATENT DOCUMENTS

| | | | |
|---|---|---|---|
| 0113604 | 7/1984 | European Pat. Off. . | |
| 1456057 | 9/1965 | France . | |
| 6937151 | 8/1969 | Germany . | |
| 1961243 | 7/1970 | Germany . | |
| 2147304 | 3/1973 | Germany . | |
| 2333691 | 1/1975 | Germany . | |
| 2419427 | 11/1975 | Germany . | |
| 7717705 | 6/1977 | Germany . | |
| 8121429 | 6/1982 | Germany . | |
| 8805559 | 8/1988 | Germany . | |
| 8912654 | 2/1990 | Germany . | |
| 9203736 | 10/1993 | Germany . | |
| 540681 | 12/1971 | Switzerland . | |
| 543268 | 4/1972 | Switzerland . | |
| 615388 | 1/1949 | United Kingdom . | |
| 1299029 | 7/1971 | United Kingdom | 223/93 |

*Primary Examiner*—Bibhu Mohanty
*Attorney, Agent, or Firm*—Robert W. Becker & Associates

[57] ABSTRACT

A clamping coat hanger has a main clamping member with an upper and a lower end, wherein the upper end has a hook for suspending the coat hanger and the lower end has first clamping ribs. A first clamping member has an upper and a lower end wherein the lower end has second clamping ribs and the upper end has a first pressure application location. The main clamping member and the first clamping member are pivotably connected to one another in the area between the upper and the lower ends thereof. The main clamping member and the first clamping member have cooperating pivot members. The cooperating pivot members are pivotable about a pivot axis parallel to a longitudinal extension of the clamping ribs. The pivot members engage behind one another by transversely intersecting the pivot axis. A first elastic element is connected to the clamping members above the pivot axis for forcing the main clamping member and the first clamping member apart and simultaneously forcing the pivot members into engagement such that the clamping ribs clamp a garment therebetween.

16 Claims, 4 Drawing Sheets

CLAMPING COAT HANGER FOR GARMENTS

BACKGROUND OF THE INVENTION

The present invention relates to a clamping coat hanger for garments comprised of at least two clamping elements that under the force of a spring are pivotable relative to one another about a pivot point at approximately a central height of the two members. In the area of their lower edges they have clamping zones for clamping the garments and for this purpose are provided with a clamping rip. One clamping member at the upper end is provided with a hook for suspending the coat hanger and the other clamping member at its upper end is provided with a pressure application location.

Clamping coat hangers based on this principle have been known for a long time. The counter pressure of the clamping members according to U.S. Pat. No. 5,020,704, European Patent Application 0 113 604, German Offenlegungsschrift 2 333 691, German Offenlegungsschrift 1 161 243, German Offenlegungsschrift 2 147 304, German Gebrauchsmuster 7 717 705, German Gebrauchsmuster 8 805 559, German Gebrauchsmuster 8 912 654, German Gebrauchsmuster 8 121 429 is, in general, achieved with a clamping lock which, upon continuous use loses its clamping force due to over extension.

According to German Offenlegungsschrift 2 419 427 a clamping coat hanger is known which is comprised of two pivotably connected halves which are pressure-loaded by a U-shaped leaf spring positioned between the two halves. The ends of the leaf spring are held in position by snap hooks. Between the leaf spring guide tabs are provided which receive a pivot pin in order to stabilize the position of the leaf spring. This design has the disadvantage that, despite the stabilizing elements, the pivot point is not sufficiently stabilized and that the leaf spring therefore cannot optimally provide the required clamping action and that furthermore the clamping forces do not act across the entire width of the halves. A corresponding coat hanger is also known from British Patent Application 615 388 whereby individual clamping stays are distributed over the width of the coat hanger. The pivot axis is formed by axle pins and clamping forces cannot act over the entire width of the clamping halves. In the coat hanger design according to German Gebrauchsmuster 92 03 736 individual bracket-type clamping stays are arranged at both ends of the coat hanger. The two halves of the coat hanger are provided with hinge parts.

A further coat hanger of the aforementioned kind is known from German Gebrauchsmuster 69 37 151 in which below the pivot axis a tension spring is provided between the two clamping members.

It is therefore an object of the present invention to provide a clamping coat hanger of the aforementioned kind with which a permanent fast and reliable clamping of garments is ensured and with which a great clamping force can be achieved while providing for a simple assembly and reduced actuation force.

SUMMARY OF THE INVENTION

A clamping coat hanger according to the present invention is primarily characterized by:

A main clamping member having an upper and a lower end, the upper end having a hook for suspending the coat hanger and the lower end comprising at least one first clamping rib;

A first clamping member having an upper and a lower end, wherein the lower end comprises at least one second clamping rib and wherein the upper end has a first pressure application location;

The main clamping member and the first clamping member pivotably connected to one another in an area between the upper and the lower ends thereof, wherein the main clamping member has a first pivot member and wherein the first clamping member has a second pivot member for cooperation with the first pivot member, wherein the first and second pivot members are pivotable about a pivot axis parallel to a longitudinal extension of the first and second clamping ribs, wherein the first and second pivot members engage behind one another by transversely intersecting the pivot axis; and A first elastic element connected to the main clamping member and the first clamping member above the pivot axis for forcing the main clamping member and the first clamping member apart and simultaneously forcing the first and second pivot members into engagement such that the first and second clamping ribs clamp a garment therebetween.

Advantageously, the first and second pivot members are pivot hooks and one of the pivot hooks has a bearing cup for engagement by the other pivot hook.

Preferably, the first and second pivot members are reinforced by reinforcement ribs.

Advantageously, the elastic element is a leaf spring.

Preferably, the leaf spring is U-shaped and has a first and a second leg connected by a connecting bar.

In a preferred embodiment of the present invention, the main clamping member has a first projection and the first clamping member has a second projection. The first leg rests at the first projection of the main clamping member and the second leg rests at the second projection of the first clamping member.

Preferably, the lowest point of the connecting bar of the U-shaped leaf spring rests on an upper one of the first and second pivot members.

In a preferred embodiment of the present invention the coat hanger further comprises a second clamping member with a lower and an upper end and with a second pressure application location at the upper end thereof, the second clamping member pivotably connected to a side of the main clamping member opposite the first clamping member in an area between the upper and the lower ends thereof.

Preferably, the lower end of the second clamping member comprises at least one third clamping rib and the main clamping member has at least one fourth clamping rib for cooperation with the at least one third clamping rib of the second clamping member. The main clamping member has a third pivot member and the second clamping member has a fourth pivot member for cooperation with a third pivot member. Advantageously, the third and fourth pivot members are pivotable about a pivot axis parallel to a longitudinal extension of the third and fourth clamping ribs. The third and fourth pivot members engage behind one another by transversely intersecting the pivot axis. A second elastic element is connected to the main clamping member and the second clamping member above the pivot axis for forcing the main clamping member and the second clamping member apart and simultaneously forcing the third and fourth pivot members into engagement such that the third and fourth clamping ribs clamp a garment therebetween.

Preferably, the third and fourth pivot members are pivot hooks and one of the pivot hooks has a bearing cup for engagement by the other pivot hook.

Expediently, the third and fourth pivot members are reinforced by reinforcement ribs.

Advantageously, the second elastic element is a leaf spring.

Preferably, the leaf spring is U-shaped and has a first and second leg connected by a connecting bar.

Preferably, the main clamping member has a third projection and the second clamping member has a fourth projection. The first leg of the U-shaped leaf spring rests at the third project of the main clamping member and the second leg of the U-shaped leaf spring rests at the fourth projection of the second clamping member.

Preferably, the lowest point of the connecting bar of the U-shaped leaf spring rests on an upper one of the third and fourth pivot members.

According to the present invention, the pivotable connection of the clamping member and the clamping member is achieved with at least two pivot members which are pivotable about a pivot axis which is substantially parallel to the clamping ribs whereby the main clamping member and the first or second clamping member facing one another each have a pivot member. The pivot members cooperate with one another such that they engage behind one another by transversely intersecting the pivot axis. Between the main clamping member and the coordinated first or second clamping member an elastic element is arranged for generating the spring force. The elastic element is arranged above the pivot axis for pressing apart the main clamping member and the first or second clamping member and simultaneously forcing the pivot members into engagement.

The invention provides an especially simple clamping coat hanger construction which allows for a simple manufacture and assembly of the clamping coat hanger whereby, however, with a minimal actuation force a great clamping force results.

Due to the inventively provided pivot members provided at each one of the coordinated clamping members (in this context it is obvious that the positioning is such that the pivot members form a pivot member pair when the first or second clamping members are in the desired mounting position at the main clamping member), the respective clamping members can be first correctly positioned in a relatively simple manner relative to one another by positioning the engaging portions of the pivot members at the engaging areas. The term engaging behind in the context of the present invention is meant to include a direct as well as an indirect engagement from behind. In a direct engagement from behind it is presupposed that a portion of the pivot member directly engages a portion of the corresponding other pivot member. In an indirect engagement from behind this may be achieved by interposition of a mounting element, for example, in an axially displaced relative position of the pivot members. However, it is important to realize that the two pivot members, without any further fastening means, are pivotably connected relative to one another when they are then loaded at least in one direction relative to one another, with or without interposition of an additional mounting element. After positioning the clamping members relative to one another and correspondingly positioning the pivot members by engagement from behind relative to one another, an elastic element which is to be positioned above the pivot axis of the clamping members for forcing apart and simultaneously loading the pivot members in the direction of engagement can be inserted. Since the forces are introduced above the pivot axis, it is possible, by employing the laws of leverage, to generate correspondingly great clamping forces. The assembly and actuation of the clamping coat hanger are thus considerably simplified.

According to an advantageous embodiment of the invention the pivot members are in the form of pivot hooks one of which comprises a bearing cup which is engaged by the other. In the simplest case two hook-shaped pivot members can be provided which engage one another from behind and which are loaded by the elastic element. In an advantageous manner the pivot hooks are reinforced by reinforcement ribs. Such pivot hooks can be formed as an integral part during the manufacture of the clamping members and in a rib-reinforced embodiment can withstand great loads.

It is advantageously suggested that the elastic element is a leaf spring. In the simplest case, a leaf spring can be arranged between a fixed point at one of the clamping members and the pivot member of the other clamping member. This results not only in the generation of forces that force apart the two cooperating clamping members, but also load the clamping members in a direction transverse to the pivot axis so that automatically the two pivot members are loaded into engagement. In an advantageous manner the leaf spring is U-shaped whereby, according to another suggestion of the invention, the legs of the leaf spring are supported on inner projections of the clamping members. Inner projections are projections provided at the sides of the clamping members which face one another in the assembled position. In an especially advantageous manner the lowermost point (connecting bar) of the U-shaped leaf spring rests on the upper pivot member, which is preferably in the form of a pivot hook.

It is furthermore advantageously suggested that on both sides of the main clamping member one of the clamping members with pressure application locations is provided.

Expediently, the clamping coat hanger comprises a main clamping member with a suspending hook that is provided on each side with a lower rib-reinforced pivot hook with bearing cup. A clamping member with pressure application location and an upper rib-reinforced pivot hook as well as a leaf spring are provided on each side of the main clamping member. The ribs of the main clamping member form a clamping rib pair each with the corresponding clamping ribs of the oppositely arranged first and second clamping members.

A double clamping coat hanger according to this invention can also be simply mounted and allows for the generation of great clamping forces.

Coat hangers according to the present invention can be produced in a simple manner, which is economically very advantageous with respect to mass-produced articles such as coat hangers. They can be easily repaired, which is another important advantage compared to conventional coat hangers. Furthermore, they can be used over an extended period of time without experiencing fatigue.

BRIEF DESCRIPTION OF THE DRAWINGS

The object and advantages of the present invention will appear more clearly from the following specification in conjunction with the accompanying drawings, in which.

DESCRIPTION OF THE PREFERRED EMBODIMENTS

Figure 2:
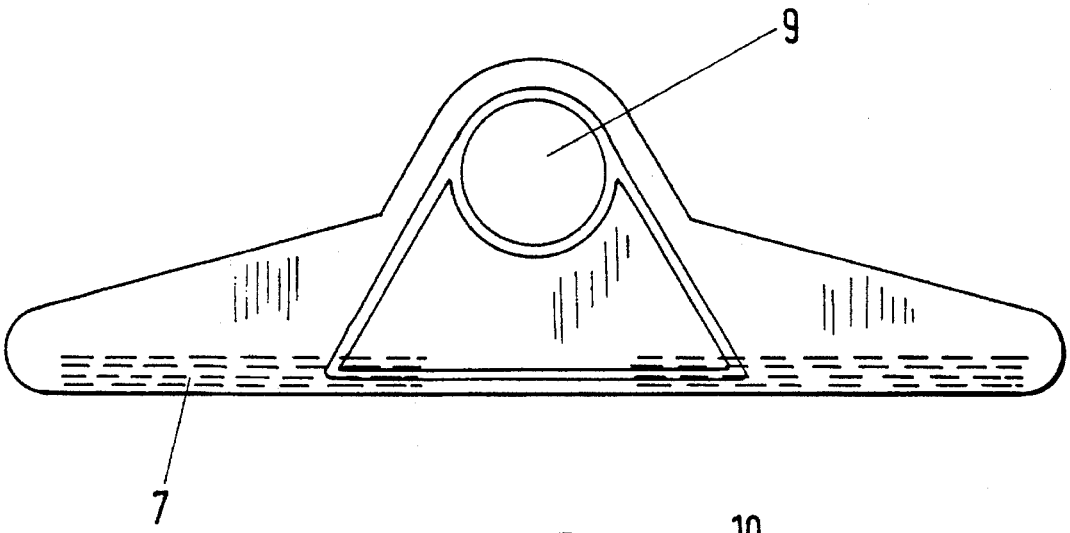
FIG. 2 shows a representation of the clamping element of the embodiment of FIG. 1.
Figure 1:
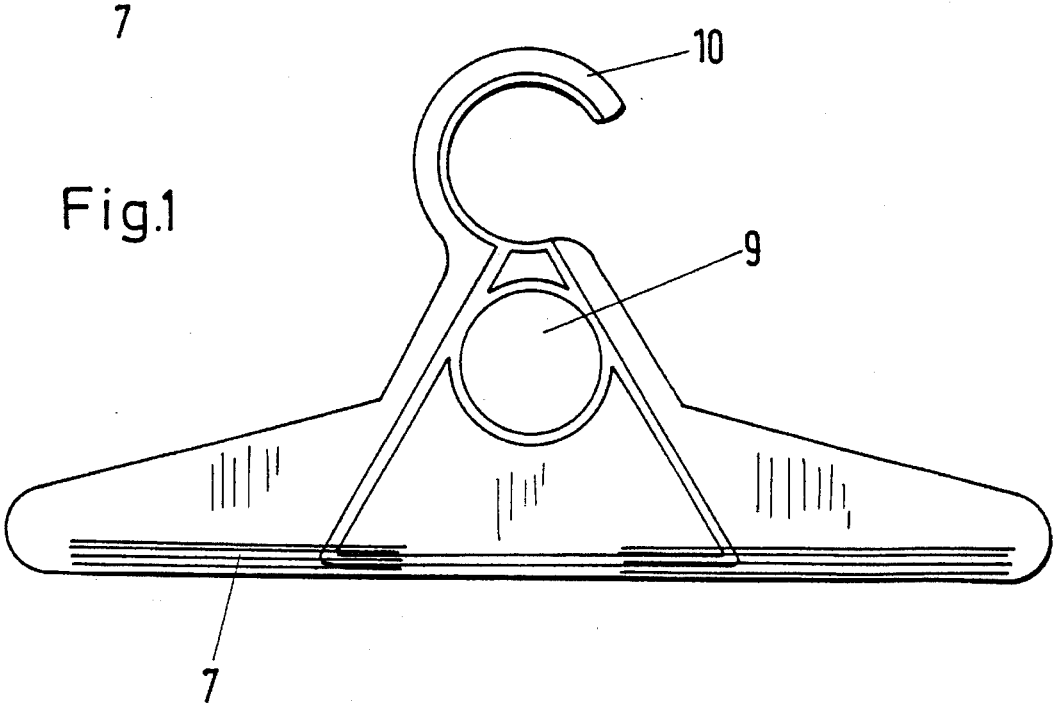
FIG. 1 shows one embodiment for a clamping coat hanger in a side view.
Figure 3:
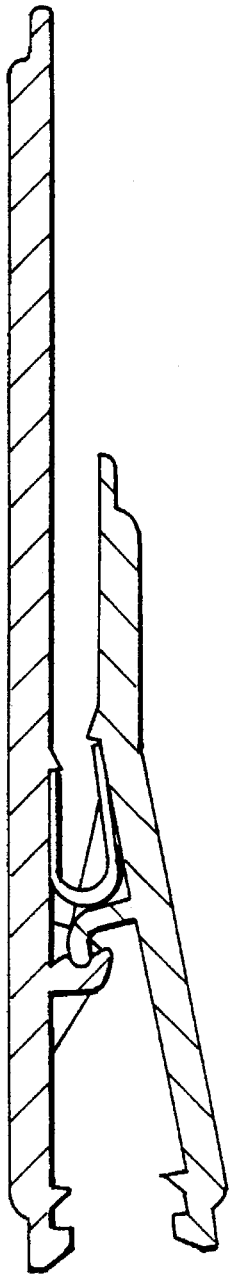
FIG. 3 shows a clamping coat hanger in a vertical section in the open position.
Figure 4:
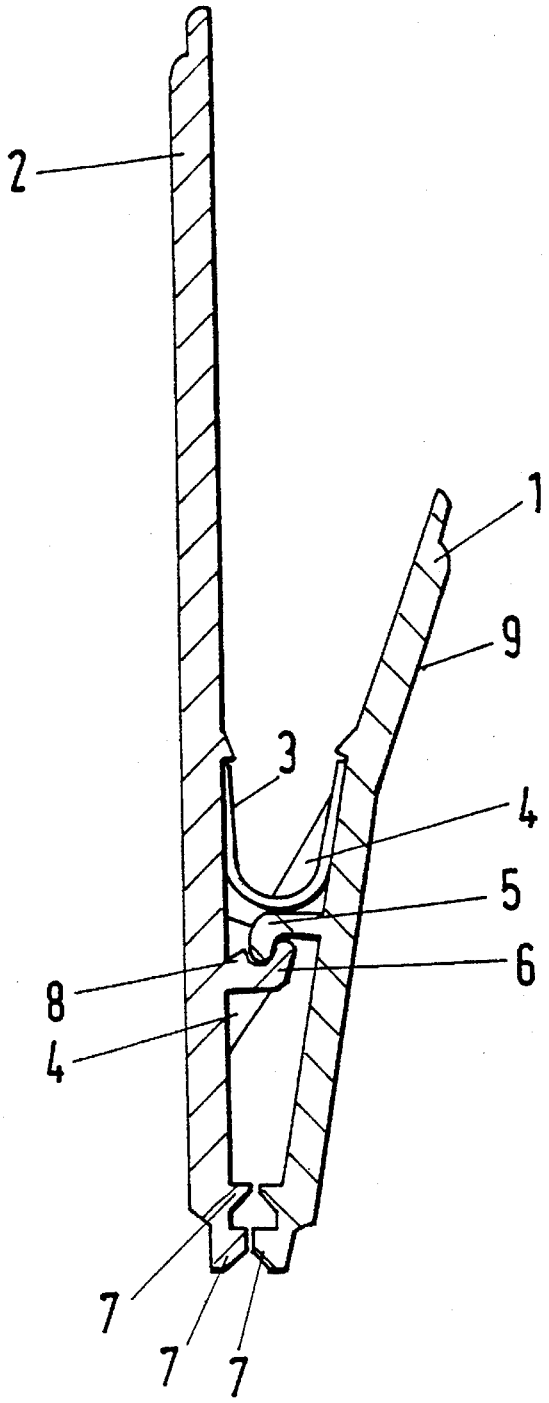
FIG. 4 shows a clamping coat hanger of FIG. 3 in the closed position.
Figure 5:
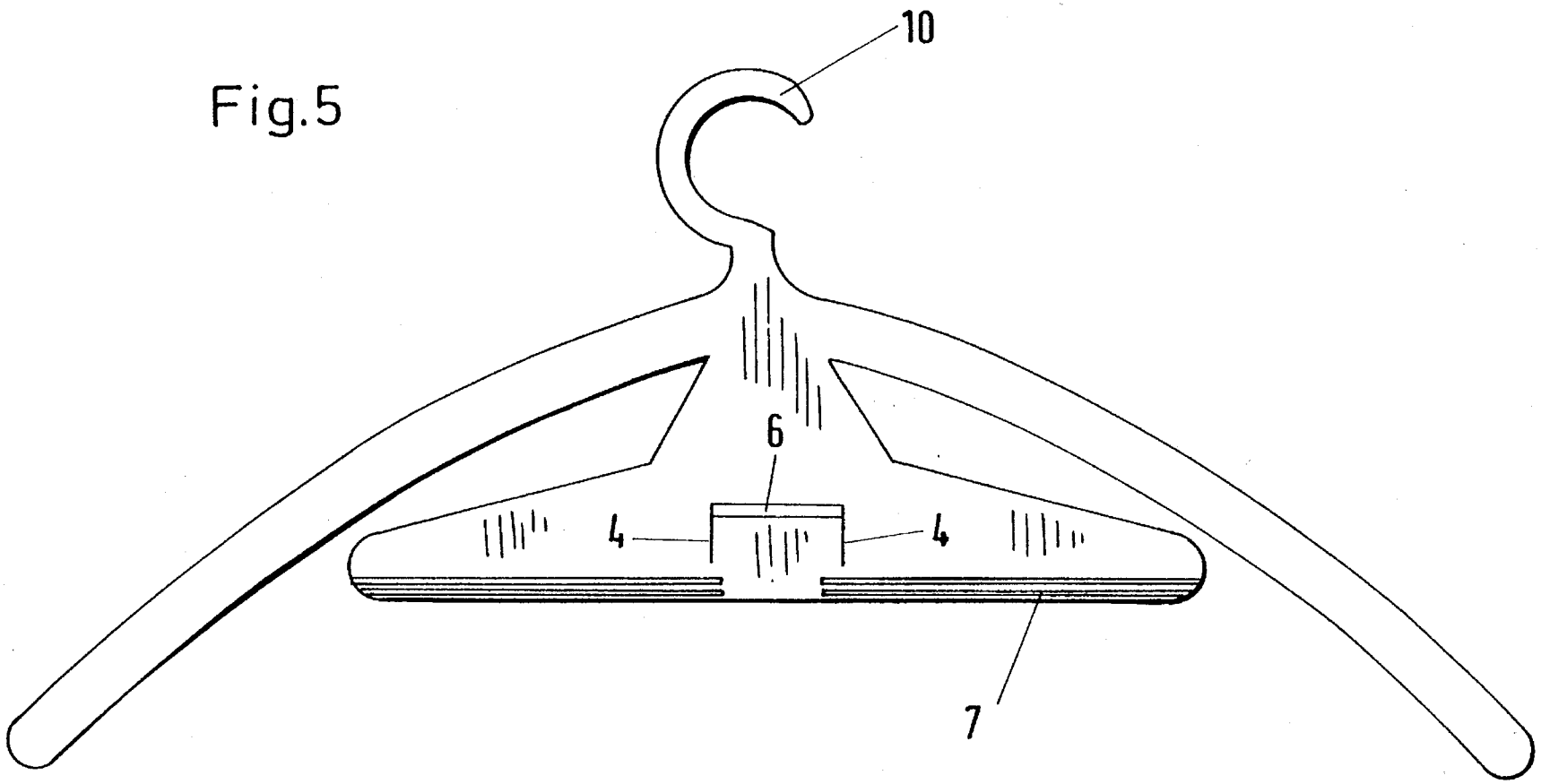
FIG. 5 shows an embodiment for a double clamping coat hanger in a side view.
Figure 6:
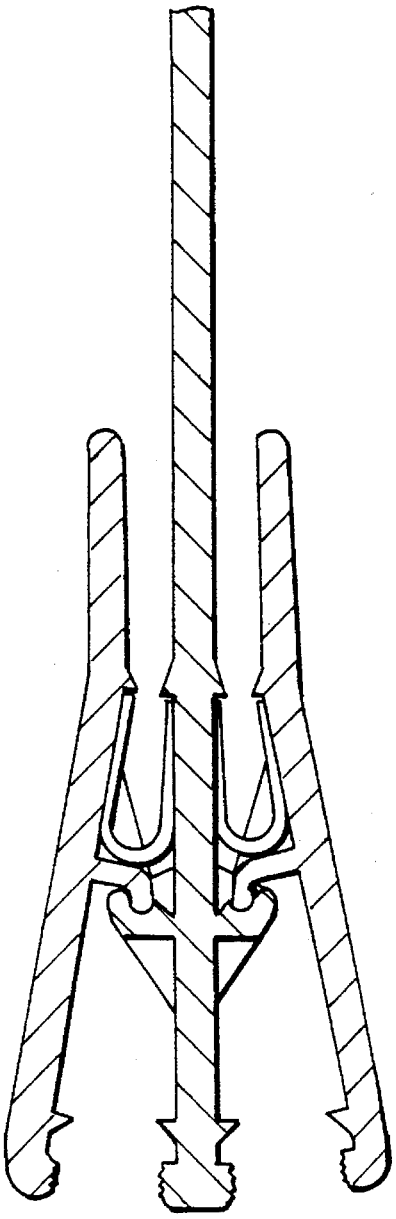
FIG. 6 shows a double clamping coat hanger in vertical section in the open position.
Figure 7:
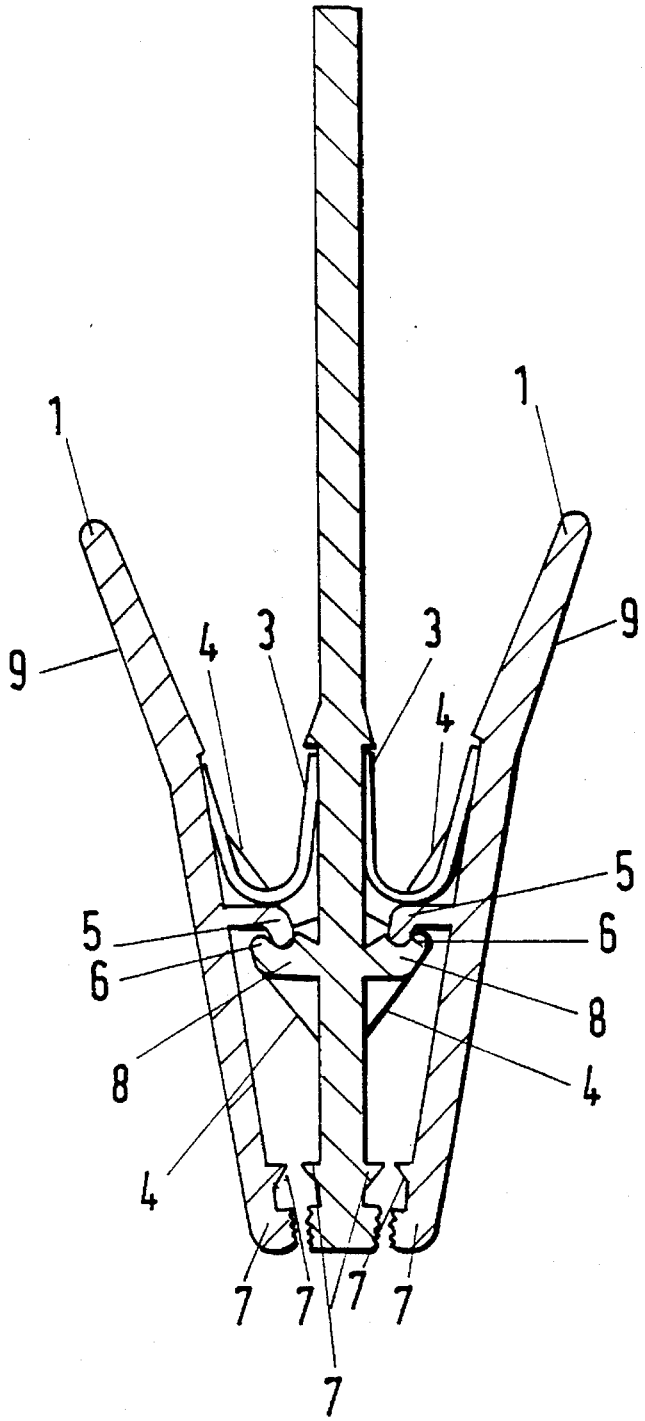
FIG. 7 shows the double clamping coat hanger of FIG. 6 in the closed position.

The present invention will now be described in detail with the aid of several specific embodiments utilizing FIGS. 1 through 7.

The clamping coat hanger represented in FIGS. 1 through 5 is comprised of a clamping member 1 with pressure application location 9 as well as an upper pivot hook 5 and is further comprised of a main clamping member 2 with suspending hook 10. Between the clamping member 1 and the main clamping member 2 a U-shaped leaf spring 3 is arranged at approximately the central height of both clamping members 1, 2. The lowest point of the connecting bar of the leaf spring 3 is resting on the upper pivot hook 5. At the central height of the clamping member 2 a lower pivot hook 6 is fastened which comprises a bearing cup 8 which is engaged by the end of the upper pivot hook 5. Both pivot hooks 5 and 6 are provided with reinforcement ribs 4. At the lower end of the clamping member 1 and main clamping member 2 clamping ribs 7 are arranged. The first 5 and second 6 pivot hooks engage and hook behind one another by transversely intersecting the pivot axis.

A further embodiment shows the clamping coat hanger with two clamping rib pairs 7 whereby the main clamping member 2 with suspending hook 10 is provided on both sides with a clamping member 1 with pressure application location 9 and upper pivot hook 5 with reinforcement rib 4, a respective U-shaped leaf spring 3, and clamping ribs 7, respectively. The clamping member 2 at its central height is provided on both sides with lower pivot hooks 6 with bearing cup 8 and reinforcement ribs 4 for engagement of the upper pivot hook 5. At the lower end of the main clamping member 2 and of the two clamping members 1 clamping ribs 7 are arranged.

By compressing the two clamping members 1, 2 at the hook end with one hand, whereby the pressure is exerted with the thumb onto the pressure application location 9, the clamping coat hanger opens so that a garment, for example, the seam of a pair of trousers, can be inserted. Upon releasing the clamping members 1, 2, the clamping coat hanger closes and the garment is clamped by the transmitted spring force.

By compressing the leaf spring 3 the upper and the lower pivot hooks 5 and 6 are displaced relative to one another and thus form a pivot point (axis). The spring force acts through the pivot point from the exterior to the interior and transfers its action onto the clamping ribs 7. The stable support of the leaf spring 3 and of the pivot hooks 5 and 6 for forming the pivot point is ensured by the reinforcement ribs 4 provided on both sides thereof.

The inventive clamping coat hanger is easy to manipulate, provides a high pressure action due to correspondence of the leaf spring 3 with the pivot hooks 5 and 6 along the entire width of the clamping members 1, 2 and thus provides for an excellent clamping action. This clamping coat hanger can be manufactured in a simple manner and has a plurality of uses not only for garments but also for fabric samples, for clamping paper etc.

According to the latest fashion trend of providing a suit with two pairs of trousers, the double clamping coat hanger is very advantageous.

The embodiments show that the respective elastic element acts in two directions onto the cooperating members. On the one hand, the clamping members are forced apart above the pivot axis, on the other hand, the two pivot members are loaded in the direction of their engagement so that an accidental disengagement of the pivot members, pivot hooks in the shown embodiments, is prevented.

The figures show that the clamping area is substantially parallel to the lower edges of the clamping members, depending on the design of the clamping ribs. The pivot members, in the shown embodiments pivot hooks, thus rotate about an axis which is essentially parallel to the lower edges. In the embodiments it is also shown with the aid of the pivot hooks 5, 6 that they engage behind one another in a direction which is substantially perpendicular to the pivot axis. The U-shaped leaf spring 3 shown in the embodiments thus not only forces apart the main clamping member 2 and the corresponding clamping members 1 above the pivot axis so that they are forced toward one another below the pivot axis, but also forces the main clamping member 2 with the pivot hook 6 provided with the bearing cup 8 in a direction substantially perpendicular to the pivot axis while it forces the clamping member 1 with the pivot hook 5 into the opposite direction by resting with its central portion on the pivot hook 5.

The present invention is, of course, in no way restricted to the specific disclosure of the specification and drawings, but also encompasses any modifications within the scope of the appended claims.

What I claim is:

1. A clamping coat hanger comprising:

a main clamping member having an upper and a lower end, said upper end having a hook for suspending said coat hanger and said lower end comprising at least one first clamping rib;

a first clamping member having an upper and a lower end, wherein said lower end comprises at least one second clamping rib and wherein said upper end has a first pressure application location;

said main clamping member and said first clamping member pivotably connected to one another in an area between said upper and said lower ends thereof, wherein said main clamping member has a first pivot hook member and wherein said first clamping member has a second pivot hook member for cooperation with said first pivot hook member, wherein said first and second hook pivot hook members are pivotable about a pivot axis parallel to a longitudinal extension of said first and second clamping ribs, wherein said first and second pivot hook members engage and hook one behind one another by transversely intersecting said pivot axis; and a first elastic element connected to said main clamping member and said first clamping member above said pivot axis for forcing said main clamping member and said first clamping member apart and simultaneously forcing said first and second pivot hook members into engagement such that said first and second clamping ribs clamp a garment therebetween.

2. A coat hanger according to claim 1, wherein one of said pivot hooks has a bearing cup for engagement by the other pivot hook.

3. A coat hanger according to claim 1, wherein said first and second pivot hook members are reinforced by reinforcement ribs.

4. A coat hanger according to claim 1, wherein said elastic element is a leaf spring.

5. A coat hanger according to claim 4, wherein said leaf spring is U-shaped and has a first and a second leg connected by a connecting bar.

6. A coat hanger according to claim 5, wherein:

said main clamping member has a first projection;

said first clamping member has a second projection; and said first leg rests at said first projection of said main clamping member and said second leg rests at said second projection of said first clamping member.

7. A coat hanger according to claim 5, wherein the lowest point of said connecting bar of said U-shaped leaf spring rests on an upper one of said first and second pivot members.

8. A coat hanger according to claim 1, further comprising a second clamping member with a lower and an upper end and with a second pressure application location at said upper end thereof, said second clamping member pivotably connected to a side of said main clamping member opposite said first clamping member in an area between said upper and said lower ends thereof.

9. A coat hanger according to claim 8, wherein:

said lower end of said second clamping member comprises at least one third clamping rib and said main clamping member has at least one fourth clamping rib for cooperation with said at least one third clamping rib of said second clamping member;

said main clamping member has a third pivot hook member and said second clamping member has a fourth pivot hook member for cooperation with said third pivot hook member;

said third and fourth pivot hook members are pivotable about a pivot axis parallel to a longitudinal extension of said third and fourth clamping ribs;

said third and fourth pivot hook members engage and hook one behind one another by transversely intersecting said pivot axis; and a second elastic element is connected to said main clamping member and said second clamping member above said pivot axis for forcing said main clamping member and said second clamping member apart and simultaneously forcing said third and fourth pivot members into engagement such that said third and fourth clamping ribs clamp a garment therebetween.

10. A coat hanger according to claim 9, wherein one of said third and fourth pivot hooks has a bearing cup for engagement by the other pivot hook.

11. A coat hanger according to claim 9, wherein said third and fourth pivot hook members are reinforced by reinforcement ribs.

12. A coat hanger according to claim 9, wherein said second elastic element is a leaf spring.

13. A coat hanger according to claim 12, wherein said leaf spring is U-shaped and has a first and a second leg connected by a connecting bar.

14. A coat hanger according to claim 13, wherein:

said main clamping member has a third projection;

said second clamping member has a fourth projection; and said first leg rests at said third projection of said main clamping member and said second leg rests at said fourth projection of said second clamping member.

15. A coat hanger according to claim 13, wherein the lowest point of said connecting bar of said U-shaped leaf spring rests on an upper one of said third and fourth pivot members.

16. A clamping coat hanger comprising:

a main clamping member having an upper and a lower end, said upper end having a hook for suspending said coat hanger and said lower end comprising at least one first clamping rib;

a first clamping member having an upper and a lower end, wherein said lower end comprises at least one second clamping rib and wherein said upper end has a first pressure application location;

said main clamping member and said first clamping member pivotably connected to one another in an area between said upper and said lower ends thereof, wherein said main clamping member has a first pivot hook member and wherein said first clamping member has a second pivot hook member for cooperation with said first pivot member, wherein said first and second pivot hook members are pivotable about a pivot axis parallel to a longitudinal extension of said first and second clamping ribs, wherein said first and second pivot hook members engage and hook one behind one another by transversely intersecting said pivot axis;

a first elastic element connected to said main clamping member and said first clamping member above said pivot axis for forcing said main clamping member and said first clamping member apart and simultaneously forcing said first and second pivot members into engagement such that said first and second clamping ribs clamp a garment therebetween;

said elastic element is a U-shaped leaf spring and has a first and a second leg connected by a connecting bar;

said main clamping member has a first projection;

said first clamping member has a second projection; and said first leg rests at said first projection of said main clamping member and said second leg rests at said second projection of said first clamping member.

* * * * *